US007007537B1

(12) United States Patent
Brown et al.

(10) Patent No.: US 7,007,537 B1
(45) Date of Patent: Mar. 7, 2006

(54) CLAM SHELL SYSTEM

(75) Inventors: Richard Brown, Anaheim, CA (US); Michael Kenneth Walker, Seal Beach, CA (US)

(73) Assignee: Omni-Lite Industries International, Inc., Christianchurch (BB)

( * ) Notice: Subject to any disclaimer, the term of this patent is extended or adjusted under 35 U.S.C. 154(b) by 239 days.

(21) Appl. No.: 10/690,807

(22) Filed: Oct. 22, 2003

(51) Int. Cl.
*B21D 22/00* (2006.01)

(52) U.S. Cl. ..... 72/357; 72/352

(58) Field of Classification Search ..... 72/344, 72/345, 357, 427
See application file for complete search history.

(56) References Cited

U.S. PATENT DOCUMENTS 2,278,293 A * 3/1942 Watson ..... 72/316
3,381,515 A * 5/1968 Orloff ..... 72/400
3,588,933 A * 6/1971 Shinopulos et al. ..... 470/9
4,186,587 A * 2/1980 Grigorenko et al. ..... 72/355.4
4,505,144 A * 3/1985 Sakuma et al. ..... 72/345
5,365,765 A * 11/1994 Gohl et al. ..... 72/355.6
5,606,887 A * 3/1997 Spiegelberg et al. ..... 72/357
5,946,966 A * 9/1999 Madaffer ..... 72/481.8
6,256,853 B1 * 7/2001 Piantoni et al. ..... 29/243.5
6,397,652 B1 * 6/2002 Sollami ..... 72/360

* cited by examiner

*Primary Examiner*—Derris H. Banks
*Assistant Examiner*—Debra M Wolfe
(74) *Attorney, Agent, or Firm*—Edward P. Dutkiewicz

(57) ABSTRACT

A work piece has an interior cylindrical component. The interior cylindrical component is composed of a beam. The beam is adapted to apply pressure to remove the work piece. An intermediate cylindrical component has four radial spaced cylindrical control arms, an interior flange and an exterior pair of semi-conical molding adapted to receive a work piece. An exterior cylinder housing is adapted to house the interior component and the intermediate component. The exterior cylinder housing has a plurality of bores and a conical recess. The conical recess is adapted to receive the molding arms of the intermediate cylindrical component.

3 Claims, 4 Drawing Sheets

FIG 3
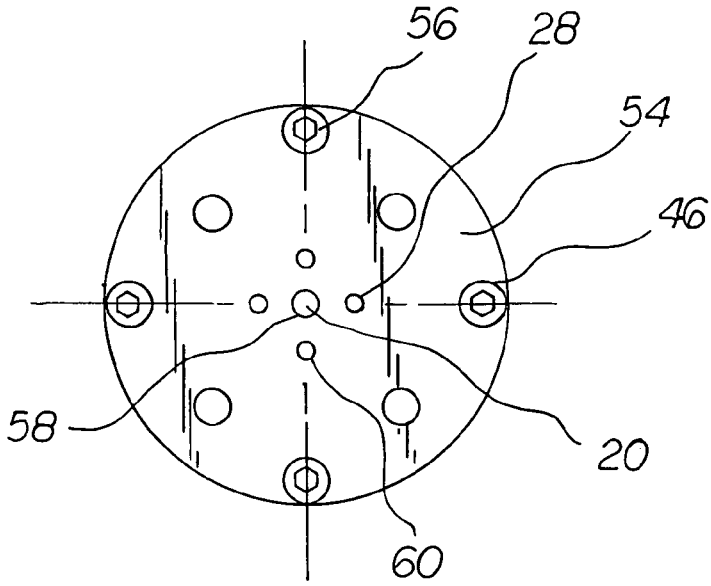
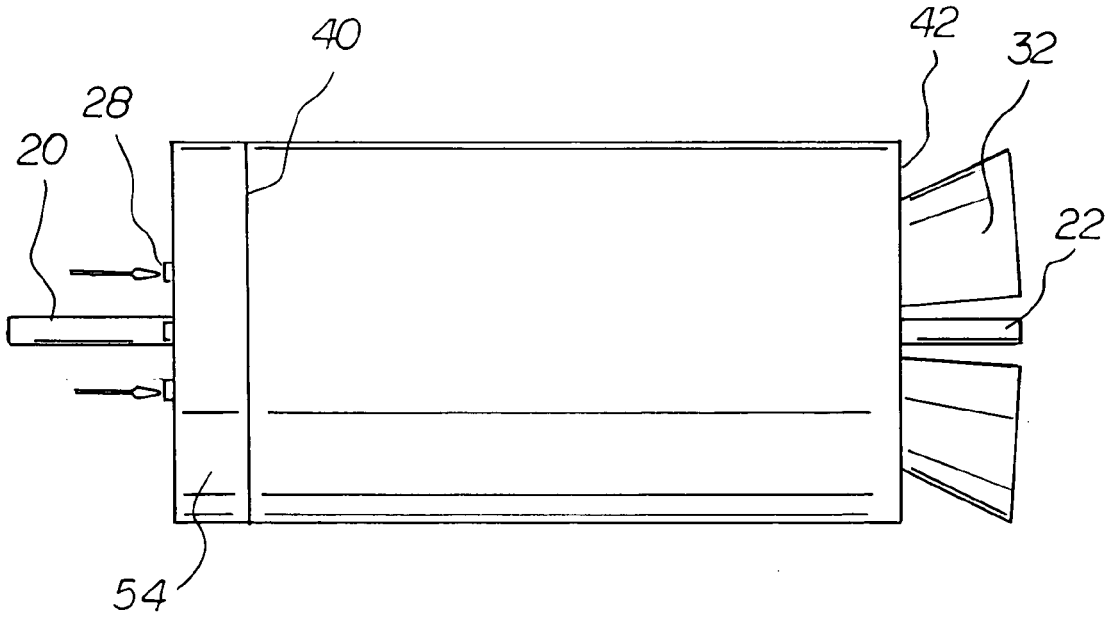
FIG 4

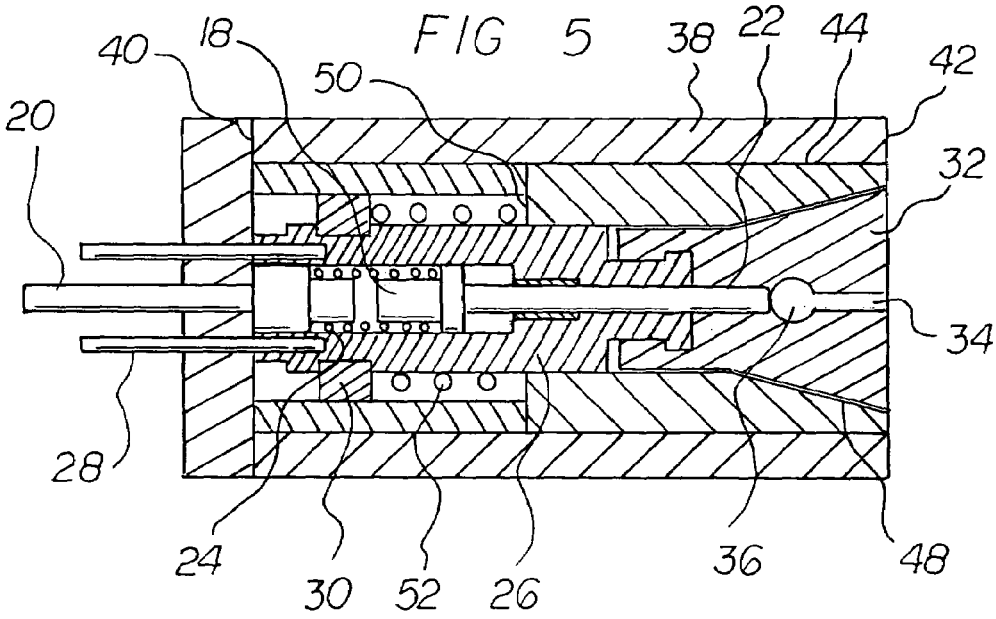
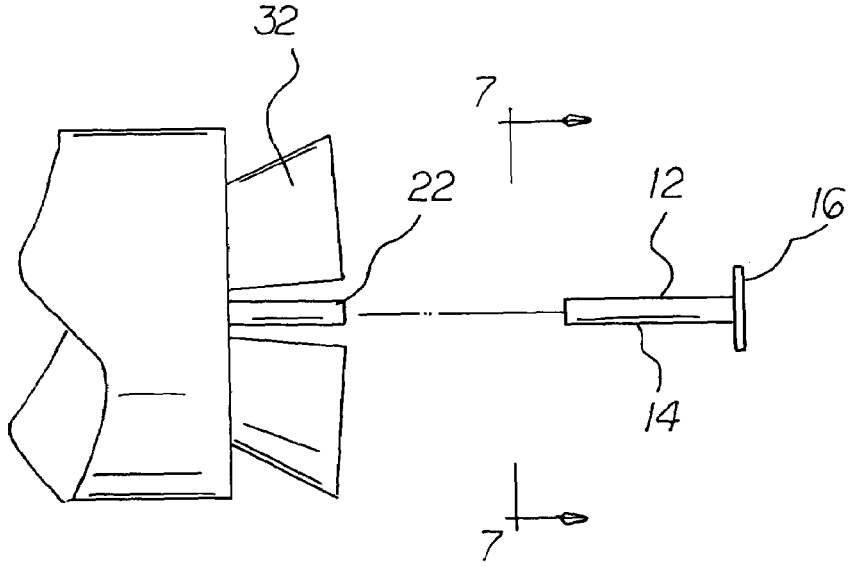
FIG 6

FIG 7
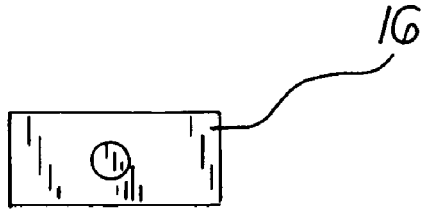
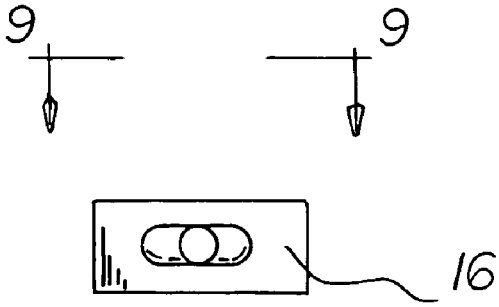
FIG 8
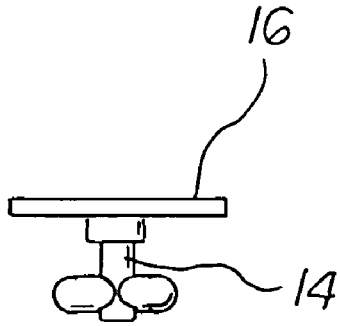
FIG 9

CLAM SHELL SYSTEM

BACKGROUND OF THE INVENTION

1. Field of the Invention

The present invention relates to a clam shell system and more particularly pertains to forming complex work pieces by cold forging in a fast and reliable manner.

2. Description of the Prior Art

The use of material forming systems of known designs and configurations is known in the prior art. More specifically, material forming systems of known designs and configurations previously devised and utilized for the purpose of material forming systems of known designs and configurations are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,397,652 to Sollami discloses a tool body and method of manufacture. U.S. Pat. No. 2,278,293 to Watson discloses a forging apparatus. U.S. Pat. No. 3,588,933 to Shinopulos et al discloses a method and apparatus for simultaneously upset forming both ends of a ductile material rod blank or the like. U.S. Pat. No. 4,186,587 to Grigorenko et al. discloses a forging press. U.S. Pat. No. 4,505,144 to Sakuma et al. discloses an apparatus for simultaneous both-end shaping of workpiece. U.S. Pat. No. 5,365,765 to Gohl et al. discloses a method and apparatus for simultaneously upsetting the ends of a cylindrical blank. U.S. Pat. No. 5,946,966 to Madaffer discloses an upset forging machine assembly having a quick change header. Lastly, U.S. Pat. No. 6,256,853 to Piantoni et al. discloses a crimping die employing powered chuck. While these devices fulfill their respective, particular objectives and requirements, the aforementioned patents do not describe a clam shell system that allows forming complex work pieces by cold forging in a fast and reliable manner.

In this respect, the clam shell system according to the present invention substantially departs from the conventional concepts and designs of the prior art, and in doing so provides an apparatus primarily developed for the purpose of forming complex work pieces by cold forging in a fast and reliable manner.

Therefore, it can be appreciated that there exists a continuing need for a new and improved clam shell system which can be used for forming complex work pieces by cold forging in a fast and reliable manner. In this regard, the present invention, as illustrated by the herein-disclosed primary embodiment thereof, substantially fulfills this and various associated needs.

SUMMARY OF THE INVENTION

In view of the foregoing disadvantages inherent in the known types of material forming systems of known designs and configurations now present in the prior art, the present invention provides an improved clam shell system. As such, the general purpose of the present invention, which will be described subsequently in greater detail, is to provide a new and improved clam shell system and method which has all the advantages of the prior art and none of the disadvantages.

To attain this, the present invention essentially comprises a work piece. The work piece has an initial form. The initial form has a long cylindrical projection and a base.

An interior cylindrical component is provided next. The interior cylindrical component is composed of a central inner beam. The interior cylindrical component is also composed of a central outer beam. The central outer beam is coupled with a first spring. The spring is adapted to apply pressure to the outer beam. In this manner the work piece is removed following manipulation. In this manner the work piece is further controlled by pressure applied to the inner beam.

An intermediate cylindrical component is provided next. The intermediate cylindrical component is adapted to house the interior cylindrical component. The intermediate cylindrical component has four radially spaced cylindrical control arms. The control arms extend inwardly. An interior flange and an exterior pair of semi-conical molding arms are provided. The arms have a coaxial groove. The groove is provided adjacent to a perpendicular recess in the molding arms. The arms are adapted to receive the work piece when extended. The arms form the work piece when retracted.

Also provided is an exterior housing. The exterior housing has a cylindrical configuration. The exterior housing has an inner edge, an outer edge and a hollow interior. The exterior housing is adapted to house the interior component and the intermediate component. The interior edge has a plurality of bores. The interior edge also has a conical recess. The conical recess is adjacent to the exterior edge. The conical recess terminates with a ledge. The conical recess is adapted to receive the molding arms of the intermediate cylindrical component.

Further provided is a second spring. The second spring is adapted to rest upon the interior flange of the intermediate component and the ledge of the exterior housing. In this manner the molding arm is forced to retract. When pressure is applied to the four control arms of the intermediate component the second spring is compressed and the molding arms are extended. Pressure applied to the inner beam of the interior component while the molding arms are extended will cause the outer beam to remove the working piece.

Provided last is an interior end plate. The interior end plate is in a cylindrical configuration. A plurality of screws is provided. The interior end plate is adapted to be coupled to the bores on the inner edge of the exterior housing. A plurality of screws is provided. The end plate has a central aperture. The central aperture allows the passage of the inner beam of the interior component. Four radially spaced apertures are provided. The radially spaced apertures allow the passage of the control arms of the intermediate component. The end plate allows the system to be controlled by exterior sources without affecting the internal parts.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved clam shell system which has all of the advantages of the prior art material forming systems of known designs and configurations and none of the disadvantages.

It is another object of the present invention to provide a new and improved clam shell system which may be easily and efficiently manufactured and marketed.

It is further an object of the present invention to provide a new and improved clam shell system which is of durable and reliable constructions.

An even further object of the present invention is to provide a new and improved clam shell system which is susceptible of a low cost of manufacture with regard to both materials and labor, and which accordingly is then susceptible of low prices of sale to the consuming public, thereby making such clam shell system economically available to the buying public.

Even still another object of the present invention is to provide a clam shell system for forming complex work pieces by cold forging in a fast and reliable manner.

Lastly, it is an object of the present invention to provide a new and improved clam shell system. A work piece has an interior cylindrical component. The interior cylindrical component is composed of a beam. The beam is adapted to apply pressure to remove the work piece. An intermediate cylindrical has four radial spaced cylindrical control arms, an interior flange and an exterior pair of semi-conical molding adapted to receive a work piece. An exterior cylinder housing is adapted to house the interior component and the intermediate component. The exterior cylinder housing has a plurality of bores and a conical recess. The conical recess is adapted to receive the molding arms of the intermediate cylindrical component.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a left side elevational view taken along line 3—3 of FIG. 1.

FIG. 4 is a front elevational view similar to FIG. 1 but with the components in an orientation after a cold forging operation.

FIG. 5 is a cross sectional view taken along line 5—5 of FIG. 2.

FIG. 6 is a front elevational view similar to FIG. 4 but with the components in an orientation prior to a cold forging operation on a workpiece.

FIG. 7 is an end elevational view of a workpiece prior to a cold forging operation and to taken along line 7—7 of FIG. 6.

FIG. 8 is an end elevational view of a workpiece similar to FIG. 8 but following a cold forging operation.

FIG. 9 is a plan view of a workpiece following a cold forging operation taken along line 9—9 of FIG. 8.

The same reference numerals refer to the same parts throughout the various Figures.

DESCRIPTION OF THE PREFERRED EMBODIMENT

Figure 1:
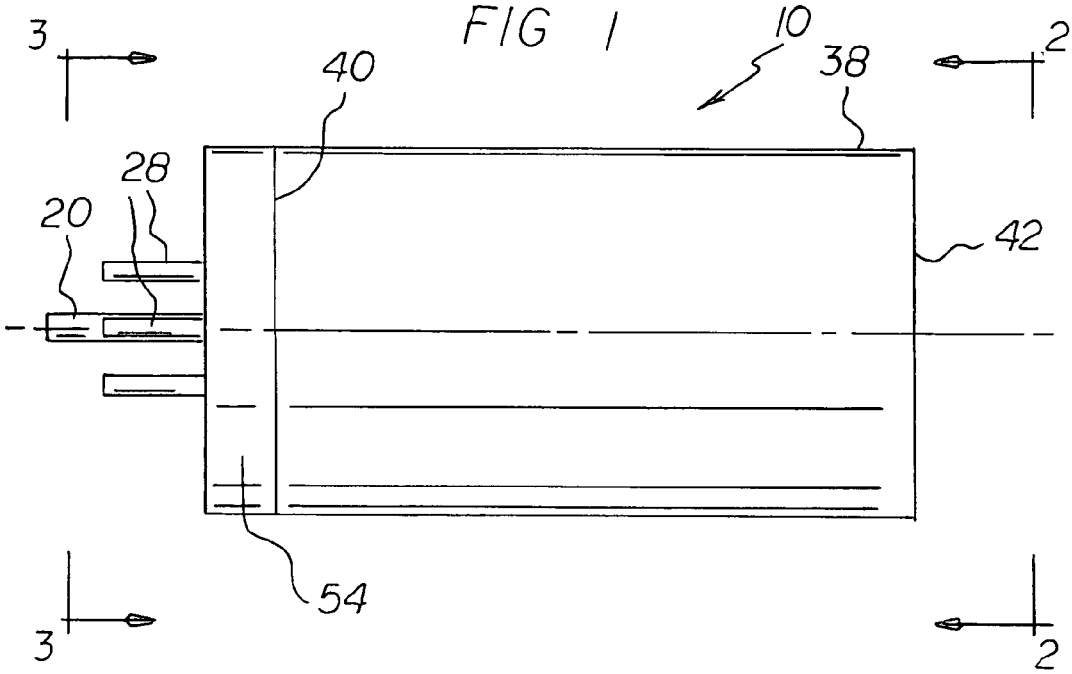
FIG. 1 is a front elevational view of a clam shell system constructed in accordance with the principles of the present invention.
Figure 2:
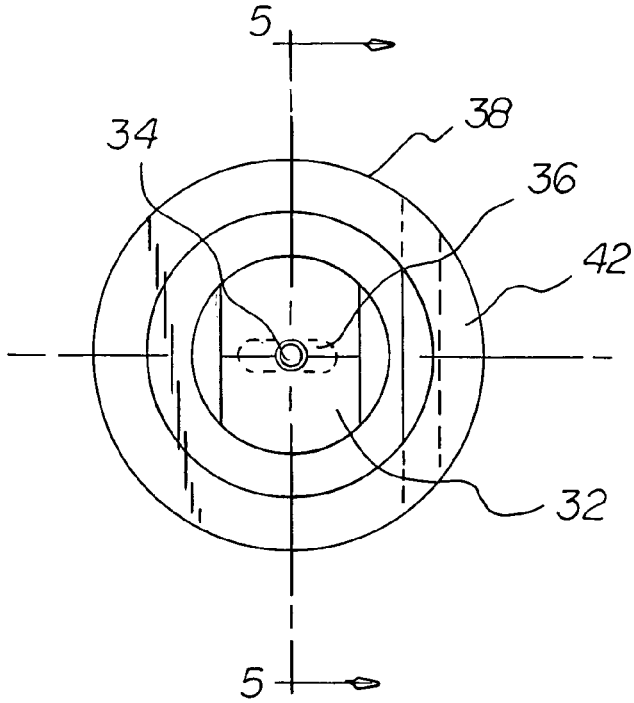
FIG. 2 is a right side elevational view taken along line 2—2 of FIG. 1.

With reference now to the drawings, and in particular to FIG. 1 thereof, the preferred embodiment of the new and improved clam shell system embodying the principles and concepts of the present invention and generally designated by the reference numeral 10 will be described.

The present invention, the clam shell system 10 is comprised of a plurality of components. Such components in their broadest context include a work piece, an intermediate cylindrical component, and an exterior cylinder. Such components are individually configured and correlated with respect to each other so as to attain the desired objective.

First provided is a work piece 12. The work piece has an initial form. The initial form has a long cylindrical projection 14 and a base 16.

An interior cylindrical component 18 is provided next. The interior cylindrical component is composed of a central inner beam 20. The interior cylindrical component is also composed of a central outer beam 22. The central outer beam is coupled with a first spring 24. The spring is adapted to apply pressure to the outer beam. In this manner the work piece is removed following manipulation. In this manner the work piece is further controlled by pressure applied to the inner beam.

An intermediate cylindrical component 26 is provided next. The intermediate cylindrical component is adapted to house the interior cylindrical component. The intermediate cylindrical component has four radially spaced cylindrical control arms 28. The control arms extend inwardly. An interior flange 30 and an exterior pair of semi-conical molding arms 32 are provided. The arms have a coaxial groove 34. The groove is provided adjacent to a perpendicular recess 36 in the molding arms. The arms are adapted to receive the work piece when extended. The arms form the work piece when retracted.

Also provided is an exterior housing 38. The exterior housing has a cylindrical configuration. The exterior housing has an inner edge 40, an outer edge 42 and a hollow interior 44. The exterior housing is adapted to house the interior component and the intermediate component. The interior edge has a plurality of bores 46. The interior edge also has a conical recess 48. The conical recess is adjacent to the exterior edge. The conical recess terminates with a ledge 50. The conical recess is adapted to receive the molding arms of the intermediate cylindrical component.

Further provided is a second spring 52. The second spring is adapted to rest upon the interior flange of the intermediate component and the ledge of the exterior housing. In this manner the molding arm is forced to retract. When pressure is applied to the four control arms of the intermediate component the second spring is compressed and the molding arms are extended. Pressure applied to the inner beam of the interior component while the molding arms are extended will cause the outer beam to remove the working piece.

Provided last is an interior end plate 54. The interior end plate is in a cylindrical configuration. A plurality of screws 56 is provided. The interior end plate is adapted to be coupled to the bores on the inner edge of the exterior housing. A plurality of screws 56 is provided. The end plate has a central aperture 58. The central aperture allows the passage of the inner beam of the interior component. Four radially spaced apertures are provided. The radially spaced apertures 60 allow the passage of the control arms of the intermediate component. The end plate allows the system to be controlled by exterior sources without affecting the internal parts.

The present invention is a system for forming coupling link cartridges or similar parts. The system allows the forging of complex double ended components where both ends have a feature or head that exceeds the diameter of the central shaft. The system allows the formation of complex parts at high speeds where traditional processes are much slower. The complex parts are formed in continuous progressive operation which takes advantage of the fact that the components are forged at an elevated temperature allowing material flow to occur under more favorable conditions than when done at ambient temperatures. This leads to reduced grain growth in critical areas of the forging producing a stronger part with increased ductility and yield strength. This also prevents massive dislocations, cracks, or failure planes from being produced in the parts.

The system features a positive opening system driven by an air cylinder which mandates that the jaw will open to allow the assured knockout (ejection) of the forged component. This prevents the system from double loading a second component into the clam with resulting damage to the system and the associated expensive tooling repairs and timely delays.

The master kickout assembly is made of 4 pins to ensure an equal distribution of force on the knockout system. This system also allows the knockout force to be distributed off the centerline of the die. This provides more control over how the jaws are opening ensuring the removal of each subsequent forging. This further eliminates damage to the jaw system. The four pins work in tandem with the die pin which, after forging each component, ejects the finished part forward clearing the clam shell between operations. This also reduced potential damage to the system.

The system ensures the proper lineup of the jaw and opposing hammer system. This ensures the proper orientation of the two forged ends. Many specifications require strict tolerances on the orientation of the opposing ends of the part.

The system has been proven to be reliable and repeatable because of multiple redundant features. This is assured by the materials and manufacturing techniques utilized in the design of the jaw system. The spring of the jaw can be adjusted to allow different forces to be applied to the system. Changing the clamping pressure on the closed die prevents material from escaping the die system and forming a burr during the forming process. This feature ensures that the material is properly distributed into the final component providing high tolerance dimensional accuracy and near net shape components as the final result.

The rectangular head is formed from material and has good grain structure flow to the grip diameter. Forming the "T" is from a reduced diameter. Forming is worked form both ends with a controlled wire diameter and computer aided monitoring.

Forming dies have good location tolerances. This makes for a more uniform grain flow and stronger part with excellent surface finishes. Other benefits include lower forming pressure, longer tool life, consistent mating of parts. Opening the dies to grip the forging stock in the die cavities for the metal to flow from both forward and reverse directions into a trapped cavity is the forming process.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A clam shell system for the formation of complex work pieces in a fast and reliable manner comprising in combination:

a work piece having an initial form with a long cylindrical projection and a base;

an interior cylindrical component being composed of a central inner beam, a central outer beam and coupled with a first spring, the spring being adapted to apply pressure to the outer beam to remove the work piece following manipulation and being controlled by pressure applied to the inner beam;

an intermediate cylindrical component adapted to house the interior cylindrical component and having four radially spaced cylindrical control arms extending inwardly, an interior flange and exterior pair of semi-conical molding arms having a coaxial groove adjacent to a perpendicular recess within the molding arms and being adapted to receive the work piece when extended and forming the work piece when retracted;

an exterior housing having a cylindrical configuration with an inner edge, an outer edge and a hollow interior being adapted to house the interior component and the intermediate component, the interior edge having a plurality of bores and a conical recess being adjacent to the exterior edge and terminating with a ledge, the conical recess being adapted to receive the molding arms of the intermediate cylindrical component;

a second spring adapted to rest upon the interior flange of the intermediate component and the ledge of the exterior housing forcing the molding arm to retract, when pressure is applied to the four control arms of the intermediate component the second spring is compressed and the molding arms are extended, pressure applied to the inner beam of the interior component while the molding arms are extended will cause the outer beam to remove the working piece; and an interior end plate of a cylindrical configuration being adapted to be coupled to the bores on the inner edge of the exterior housing with a plurality of screws, the end plate having a central aperture to allow the passage of the inner beam of the interior component and four radially spaced apertures to allow the passage of the control arms of the intermediate component, the end plate allows the system to be controlled by exterior sources without affecting the internal parts.

2. A clam shell system comprising:

a work piece;

an interior cylindrical component having an inner beam and an outer beam;

an intermediate cylindrical component having four radial spaced cylindrical control arms and an interior flange and an exterior pair of semi-conical molding arms adapted to receive a work piece;

an exterior cylinder housing adapted to house the interior component and the intermediate component and having a ledge and a plurality of bores and a conical recess adapted to receive the molding arms of the intermediate cylindrical component; and a first spring coupled to the outer beam and a second spring adapted to rest upon the interior flange of the intermediate component and the ledge of the exterior housing forcing the molding arm to retract; and wherein when pressure is applied to the control arms of the intermediate component the second spring is compressed and the molding arms are extended, and wherein when pressure is applied to the inner beam of the interior component while the molding arms are extended the outer beam is caused to remove the working piece.

3. A clam shell system comprising:

a work piece;

an interior cylindrical component having an inner beam and an outer beam;

an intermediate cylindrical component having four radial spaced cylindrical control arms and an interior flange and an exterior pair of semi-conical molding arms adapted to receive a work piece;

an exterior cylinder housing adapted to house the interior component and the intermediate component and having an inner edge and a plurality of bores and a conical recess adapted to receive the molding arms of the intermediate cylindrical component; and an interior end plate of a cylindrical configuration being adapted to be coupled to the bores on the inner edge of the exterior housing with a plurality of screws, the end plate having a central aperture to allow the passage of the inner beam of the interior component and four radial spaced apertures to allow the passage of the control arms of the intermediate component, the end plate adapted to allow the system to be controlled by exterior sources.

* * * * *